US007505006B2

(12) United States Patent
Ollikainen et al.

(10) Patent No.: US 7,505,006 B2
(45) Date of Patent: Mar. 17, 2009

(54) ANTENNA ARRANGEMENT

(75) Inventors: Jani Ollikainen, Helsinki (FI); Juha Ellä, Halikko (FI); Tero Ranta, Turku (FI); Anping Zhao, Espoo (FI)

(73) Assignee: Nokia Corporation, Espoo (FI)

( * ) Notice: Subject to any disclaimer, the term of this patent is extended or adjusted under 35 U.S.C. 154(b) by 310 days.

(21) Appl. No.: 11/450,564

(22) Filed: Jun. 8, 2006

(65) Prior Publication Data

US 2007/0285319 A1 Dec. 13, 2007

(51) Int. Cl.
*H01Q 1/24* (2006.01)

(52) U.S. Cl. ..... 343/702; 343/749; 343/750

(58) Field of Classification Search ..... 343/702, 343/700 MS, 833, 834, 749, 750, 752
See application file for complete search history.

(56) References Cited

U.S. PATENT DOCUMENTS

| | | | | |
|---|---|---|---|---|
| 5,920,293 | A * | 7/1999 | Perrotta et al. | 343/906 |
| 6,342,859 | B1 * | 1/2002 | Kurz et al. | 343/702 |
| 7,136,019 | B2 * | 11/2006 | Mikkola et al. | 343/702 |
| 2003/0169206 | A1 * | 9/2003 | Egawa | 343/702 |
| 2005/0128155 | A1 | 6/2005 | Fukuda | |
| 2006/0258414 | A1 | 11/2006 | Vance et al. | |

FOREIGN PATENT DOCUMENTS

WO WO 2007/030401 3/2007

OTHER PUBLICATIONS

International Search Report dated Mar. 18, 2008.
Juntunen, J., et al., "FDTD Simulations of a Wide-Band Half Volume DRA", 2000, IEEE, pp. 223-226.
Kivekäs, O., et al., "Wideband Dielectric Resonator Antenna for Mobile Phones", Jan. 2003, Microwave and Optical Technology Letters, vol. 36, No. 1, pp. 25-26.
Vainikainen, P., et al., "Resonator-Based Analysis of the Combination of Mobile Handset Antenna and Chassis", Oct. 2002, IEEE Transactions on Antennas and Propagation, vol. 50, No. 16, pp. 1433-1444.

* cited by examiner

*Primary Examiner*—Hoang V Nguyen
(74) *Attorney, Agent, or Firm*—Harrington & Smith, PC

(57) ABSTRACT

An antenna arrangement including: a coupling element, a conductive element; an extension element for electrically extending the conductive element and a reactive element. A method of creating an antenna arrangement including an antenna element having a first resonant frequency and a first bandwidth, a conductive element, an extension element, for electrically extending the conductive element, having a size and an inductor having an inductance value wherein the extended conductive element has a resonant mode having a second resonant frequency and a second bandwidth, the method including: selecting the size of the extension element, the inductance value and a position of the inductor to tune the resonant mode of the extended conductive element so that the second bandwidth in the region of the first resonant frequency is larger than the first bandwidth in the region of the first resonant frequency.

32 Claims, 2 Drawing Sheets

ANTENNA ARRANGEMENT

FIELD OF THE INVENTION

Embodiments of the present invention relate to an antenna arrangement. In particular, some embodiments relate to antenna arrangements that provide relatively wide bandwidths in relatively small communication devices.

BACKGROUND TO THE INVENTION

There is a current trend towards the reduction in the size of electronic devices including radio communication devices. As the size of a device is reduced the volume allocated to the various components, including the antenna, typically also reduces. As the size of an antenna is reduced this will have consequences on the resonant frequency and bandwidth of radiating resonant modes of the antenna. This may make it difficult for antennas in smaller devices to operate effectively. For example, in a mobile cellular telephone terminal of length less than 100 mm it can be difficult to cover the US-GSM and/or EGSM bands. In larger devices, however, it may be possible to cover both bands with a wide bandwidth resonance(s).

It would be desirable to provide for tuning the bandwidth and/or resonant frequency of an antenna arrangement.

In particular, it would be desirable to provide for tuning the bandwidth and/or resonant frequency of an antenna arrangement in a small device.

BRIEF DESCRIPTION OF THE INVENTION

According to one embodiment of the invention there is provided an antenna arrangement comprising: a coupling element; a conductive element; an extension element for electrically extending the conductive element; and an inductor 40.

According to another embodiment of the invention there is provided a method of creating an antenna arrangement comprising an antenna element having a first resonant frequency and a first bandwidth, a conductive element, an extension element, for electrically extending the conductive element, having a size and an inductor 40 having an inductance value wherein the extended conductive element has a resonant mode having a second resonant frequency and a second bandwidth, the method comprising: selecting the size of the extension element, the inductance value and a position of the inductor to tune the resonant mode of the extended conductive element so that the second bandwidth in the region of the first resonant frequency is larger than the first bandwidth in the region of the first resonant frequency.

BRIEF DESCRIPTION OF THE DRAWINGS

For a better understanding of the present invention reference will now be made by way of example only to the accompanying drawings in which.

DETAILED DESCRIPTION OF EMBODIMENTS OF THE INVENTION

Figure 1:
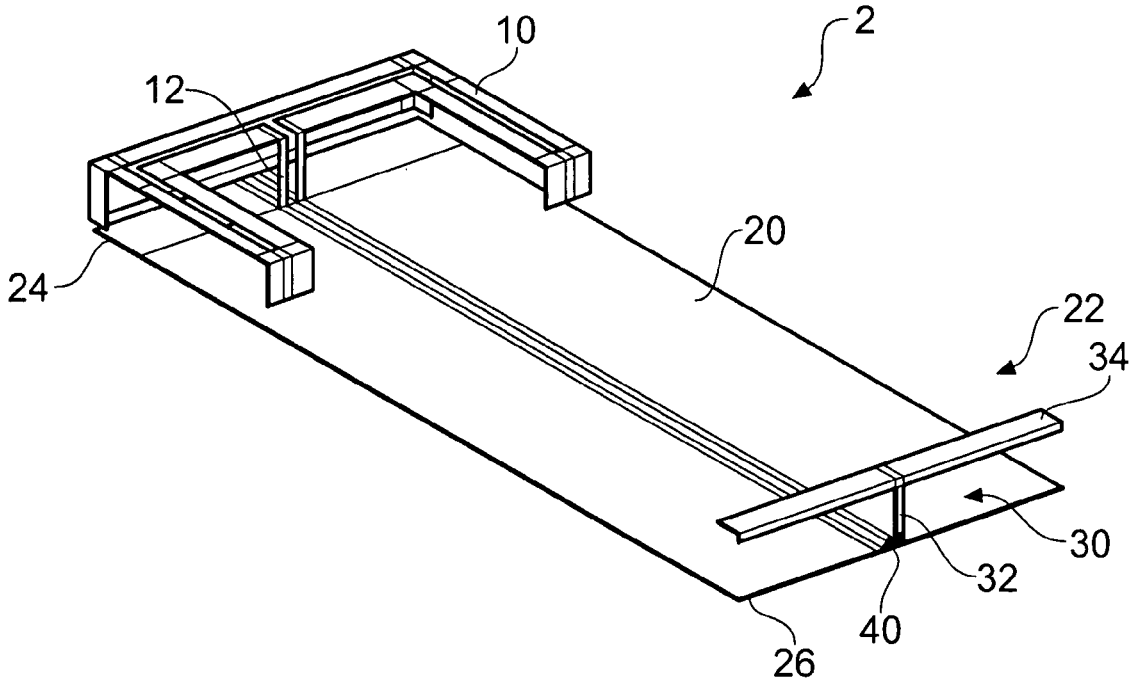
FIG. 1 illustrates an example of an antenna arrangement.

FIG. 1 illustrates an example of an antenna arrangement 2 according to one embodiment of the invention.

The antenna arrangement 2 comprises: a coupling element 10, a larger volume conductive element 20, an extension 30 and a reactive element 40 such as, for example, an inductor.

The larger volume conductive element 20 is typically a planar element such as a ground plane. It may be, for example, a printed wiring board (PWB) within a communications device 110 or a metallic chassis of the device 110. The shape of the conductive element 20 may be rectangular with two opposed end edges 24, 26 separated by the conductive element's length.

The coupling element 10 is designed to have a resonant electromagnetic (EM) mode at a desired frequency. The reflection coefficient S11 of the coupling element 10 is low at the desired frequency and the coupling element is operable as an antenna element. The antenna element 10 radiates and receives well at the desired antenna resonant frequency. However, if the coupling element 10 has a small volume (i.e. less than 10 $mm^3$) or the conductive element 20 is short, as would be expected if it is to be used in hand-portable communication devices, it may have a narrow bandwidth.

The coupling element 10 has a feed 12, which is connected to radio frequency (RF) circuitry 112 of the communications device 110. The feed 12 excites resonant EM modes in the antenna element 10.

The antenna element 10 may be a planar metallic structure. It may be any suitable antenna. It may be an unbalanced antenna such as an inverted F antenna (IFA), a planar inverted F antenna (PIFA) or a helix. It may be a loop, monopole etc The extension 30 comprises an interconnect 32 and an extension element 34. The interconnect 32 is any suitable conductive interconnect. The extension element 34 is conductive and may be a metallic planar element i.e. a plane extension. The extension 30 extends the electrical length of the conductive element 20 to create an extended conductive element 22 which operates as a ground plane for the coupling antenna element 10.

The coupling element 10 and the conductive element 20 are arranged relative to each other so that coupling of EM energy between them is, for example optimized, at the desired operating frequency. The resonant EM mode of the coupling element 10 excites EM modes in the extended conductive element 22. The extended coupling element 22 has a greater electrical volume than the coupling element 20 and consequently has a greater bandwidth in the reflection coefficient S11.

The resonant EM modes in the conductive element are typically $\lambda/2$ modes. If the electrical length of the conductive element 20 is X, and the resonant wavelength is $\lambda$, then $X=n\lambda/2$, where n is the order of the resonant mode and is an integer 1,2 . . .

Figure 2A:
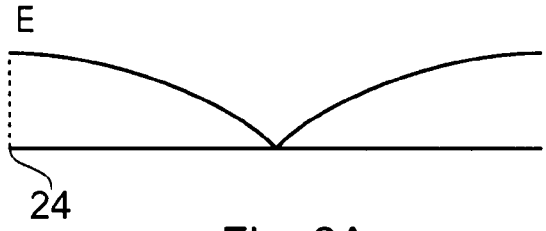
FIGS. 2A and 2B respectively illustrate, for a lowest resonant mode of an extended conductive element, the electric (E) field and the magnetic field strength (H)
Figure 2B:
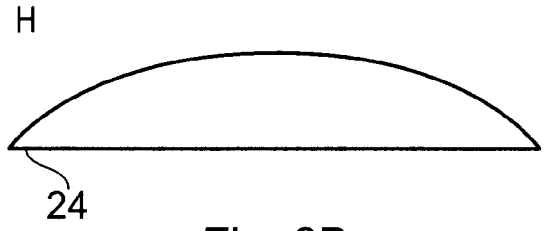

At the lowest resonant mode (n=1), as illustrated in FIGS. 2A, 2B, the maximum in the electric (E) field is at the extremities of the (extended) conductive element 22 and the maximum of the magnetic field strength (H) is at the centre of the electrical length of the extended conductive element 22. If capacitive EM coupling is used to couple EM energy from the coupling element 10 to the conductive element 20, then the coupling element is typically positioned at or near a location where the E field is high such as the edge 24 of the conductive element 20 (as illustrated in FIG. 1). If inductive EM coupling is used to couple EM energy from the coupling element 10 to the conductive element 20, then the coupling element is typically positioned at or near a location where the H field is high such as the middle of the electrical length of the extended conductive element 22.

Figure 3A:
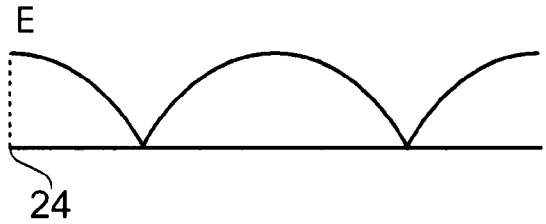
FIGS. 3A and 3B respectively illustrate, for a second lowest resonant mode of an extended conductive element, the electric (E) field and the magnetic field strength (H)
Figure 3B:
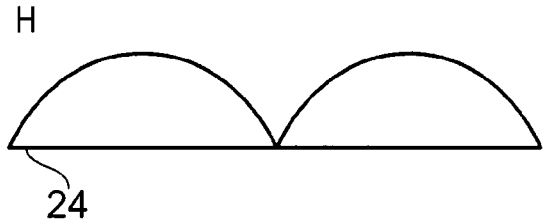

At the second lowest resonant mode (n=2), as illustrated in FIGS. 3A, 3B, the maxima in the electric (E) field is at the extremities of the (extended) conductive element 22 and at the centre of the electrical length of the extended conductive element 22. If capacitive EM coupling is used to couple EM energy from the coupling element 10 to the conductive element 20, then the coupling element is typically positioned at or near a location where the E field is high such as the edge 24 of the conductive element 20 (as illustrated in FIG. 1). The maxima in the magnetic field strength (H) are positioned ¼ of the electrical length from the centre of the electrical length of the extended conductive element 22. If inductive EM coupling is used to couple EM energy from the coupling element 10 to the conductive element 20, then the coupling element is typically positioned at or near a location where the H field is high.

The coupling antenna element 10 may be arranged as an unbalanced antenna element so that it couples more strongly with the ground plane.

To save space, a planar extension element 34 may be placed parallel to but separated from the plane of a planar conductive element 20. The planar extension element 34 and the planar conductive element may partially overlap e.g. the whole of the planar extension element 34 may overlap a portion of the planar conductive element 20.

The antenna arrangement 2 is designed so that the resonant frequency of the EM mode of the antenna coupling element 10 substantially corresponds i.e. is close but not necessarily matched to the resonant frequency of a mode of the extended conductive element 22.

The resonant frequency of the extended conductive element can be controlled by controlling the electrical length of the extended conductive element 22. One way of doing this is by controlling the length of the conductive interconnect 32 and/or the size of the extension element 34. Increasing the length of the conductive element 32 and/or increasing the size of the extension element 34 increases the electrical length, increasing the resonant wavelength and decreasing the resonant frequency.

The reactive element 40 is typically a component or collection of components which may be lumped component(s) and/or chip(s). The reactive element 40 is positioned in the current path between the conductive element and the extension 30.

The reactive element 40 may also be used to control the electrical length of the extended conductive element 22. For example, the presence of an inductor reactive element 40 having an inductance value L increases the electrical length of the extended conductive element 22 (increasing the resonant wavelength and decreasing the resonant frequency of the extended conductive element 22).

The presence of an inductor reactive element 40 also decreases the bandwidth of the reflection coefficient S11 at the resonant frequency.

The effect of the inductor 40 is also dependent upon where the inductor is positioned relative to the H field generated by the extended conductive element 22. Although the effect of the inductor 40 is greater if it is located at a position of high magnetic field strength H (i.e. high current density), it does not have to positioned here. The position of maximum H field varies as the electrical length of the extended plane element varies.

The inductor 40 may be located anywhere although maximum extension of the electrical length may be obtained by placing it at the edge 26 of the conductive element 20. This position also corresponds to a position of higher E field, which results is less current in the extension 30 and therefore less power loss.

The inductor value is typically a few mH to a few tens of nH. At high frequencies e.g. 2 GHz the inductor 40 represents an open circuit.

The size of the extension element 34 and the value and position of the inductor 40 are used to tune the resonant mode of the extended ground plane 22 so that its resonant frequency is close to or matched with the antenna element 10 resonant frequency and so that its bandwidth at that resonant frequency is sufficiently large.

Thus the electrical length of the extended conductor 22 can be increased by increasing the length of the interconnect 32 and/or also by increasing the size of the largest dimension of the extension element 34. The electrical length of the extended conductor 22 can also be increased by increasing the value of the inductor 40 and/or positioning it where the electric current is large. However, this may also decrease the bandwidth.

By a suitable choice of the inductor value L, the size of the extension 30 (in particular the extension element 34) and the position of the inductor 40 (and therefore the extension 30) the resonant mode of the extended conductive element 22 can be tuned to a desired resonant frequency and a desired bandwidth.

An increase in the inductor value L may increase the antenna arrangement bandwidth because although an increase in L may decrease the bandwidth of the extended conductive element's resonant mode it will also shift it to a lower frequency that is different to the resonant frequency of the coupling element 10.

The choice of the size of the plane extension, the value of the inductor and the position of the inductor are chosen so that the reflection coefficient S11 is less than a desired value (e.g. 6 dB) over a chosen frequency range such as, for example, dual bands of cellular radio telecommunication protocols (e.g. for US-GSM (824-894 MHz) and E-GSM (880-960 MHz) or for PCN1800 (1710-1880 MHz) and PCS1900 (1850-1990 MHz)).

Typically, it will be desirable to tune the resonant frequency of the extended conductive element 22 close to or so it matches the resonant frequency of the coupling element 10 while maintaining an appropriately large bandwidth.

The antenna arrangement 2 is therefore capable to covering a broad range of frequencies without having to meander or place slots in a ground plane.

Figure 4:
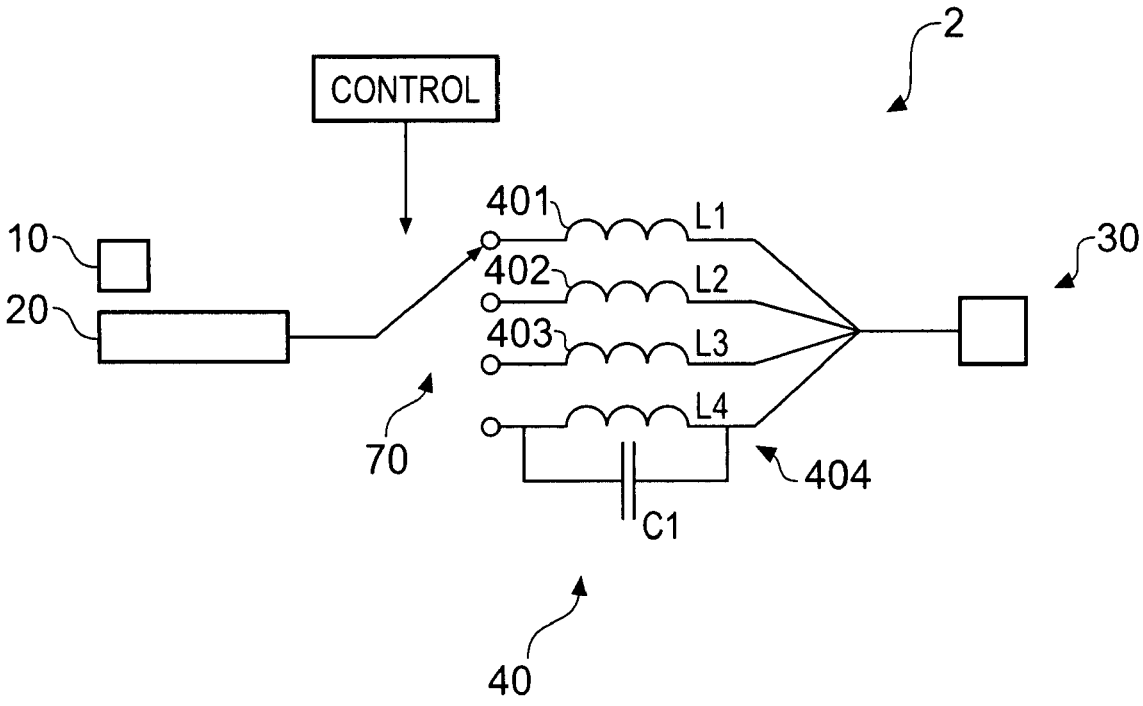
FIG. 4 illustrates a further embodiment of an antenna arrangement.

FIG. 4 illustrates a further embodiment of the invention. In this example, the antenna arrangement 2 is able to dynamically vary the reactive element 40 or introduce the reactive element 40. A controllable element 70 is operable to provide, for example, a controlled inductance L as the inductor 40. For example, the controllable element may control the inductance to have one of the values L1, L2, L3, L4 etc. The controllable element 70 may be a variable reactance or a switching element (as illustrated). The switching element 70 connects one of the different inductors 401, 402, 403, 404 in line, so that it connects the conductive element 20 and the extension 30. The switching element may be mechanically or electrically operated.

The different inductors may be impedances with an inductance. For example, the inductor 404 is an inductor in parallel with a capacitor.

The extended conductive element 22 may have a non-radiating EM resonant mode. The inductor value L tunes the frequency position of the non-radiating mode. Increasing the inductor value L decreases the frequency of the non-radiating mode.

Figure 5:
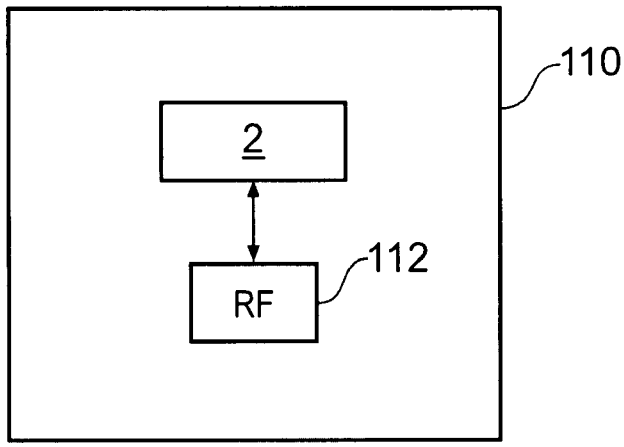
FIG. 5 schematically illustrates a communications device 110 comprising the antenna arrangement.

FIG. 5 schematically illustrates a communications device 110 comprising the antenna arrangement 2 and RF circuitry 112. The communication device may be a hand-portable terminal such as a mobile cellular telephone. The PWB of the device, which carries the RF circuitry 112, may operate as the large volume conductive element 20. The length of the PWB may be less than 110 mm and/or greater than 75 mm. The coupling antenna element 10 may have a relatively small volume e.g. less than 5 $mm^3$.

The illustrated communication device 110 has an extended configuration and an non-extended configuration. The large volume conductive element 20 is comprised of at least two parts that move relative to one another when the configuration of the device is changed. In, for example, the closed configuration the two parts may overlap whereas in the open configuration the two parts may be separated so that as a combination they have a greater maximum dimension and therefore grater electrical length. The variation in the electrical length of the large volume conductive element 20 may be compensated for by using a controllable element 70 (as described in relation to FIG. 4) to increase the electrical length.

The previous paragraphs have described an antenna arrangement 2 having a single antenna element 10 and a conductive element 20 that has an extended or extendable electrical length. It should however be appreciated that a first antenna element 10 and a second, different, antenna element 10 may share the same common conductive element. The first and second antenna elements 10 would be designed to have different resonant frequencies. In this scenario, when a reactive element of fixed value is used, the extension of the electrical length of the conductive element is fixed and will typically enhance the bandwidth of one of the antenna elements but not necessarily the bandwidth of the other antenna element. However, in this scenario, when a dynamic reactive element having multiple settings is used, the electrical length of the conductive element can be controlled to enhance the bandwidth of one of the antenna elements (but not the other) in one setting and to enhance the bandwidth of the other antenna element in another setting.

Although embodiments of the present invention have been described in the preceding paragraphs with reference to various examples, it should be appreciated that modifications to the examples given can be made without departing from the scope of the invention as claimed.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

The invention claimed is:

1. An antenna arrangement comprising:

a first coupling element, a second coupling element a conductive element an extension element for electrically extending the conductive element and a reactive element, wherein the reactive element is variable between a first setting and a second setting and wherein when the reactive element is in the first setting the extension element and reactive element in combination electrically extend the conductive element to enhance a bandwidth of the first coupling element and when the reactive element is in the second setting the extension element and reactive element in combination electrically extend the conductive element to enhance a bandwidth of the second coupling element.

2. An antenna arrangement as claimed in claim 1, wherein the first coupling element has a bandwidth and the conductive element, extended by the extension element, has a bandwidth and the bandwidth of the conductive element, extended by the extension element, is greater than the bandwidth of the first coupling element and the reactive element is an inductor.

3. An antenna arrangement as claimed in claim 2, wherein the first coupling element has a resonant frequency and the conductive element, extended by the extension element, has a resonant frequency and the resonant frequency of the conductive element, extended by the extension element, corresponds with the resonant frequency of the first coupling element.

4. An antenna arrangement as claimed in claim 1, wherein the first coupling element has a resonant frequency and the conductive element, extended by the extension element, has a resonant frequency and the resonant frequency of the conductive element, extended by the extension element, corresponds with the resonant frequency of the first coupling element.

5. An antenna arrangement as claimed in claim 1, wherein the first coupling element has a resonant frequency, the reactive element has an inductance value in the first setting and the extension element has a size and wherein the size of the extension element, the inductance value and a position of the reactive element tune a resonant mode of the extended conductive element so that the bandwidth of the extended conductive element at the resonant frequency of the first coupling element is larger than the bandwidth of the first coupling element at the resonant frequency of the first coupling element.

6. An antenna arrangement as claimed in claim 1, wherein the extension element and reactive element in combination electrically extend the conductive element to enhance a bandwidth of the first coupling element.

7. An antenna arrangement as claimed in claim 1, wherein the extended conductive element operates as a ground plane for the first coupling element.

8. An antenna arrangement as claimed in claim 1, wherein the extended conductive element has a greater electrical volume than the first coupling element.

9. An antenna arrangement as claimed in claim 1, wherein the first coupling element is a small volume antenna element compared to the conductive element.

10. An antenna arrangement as claimed in claim 1, wherein the first coupling element has a substantially planar metallic structure.

11. An antenna arrangement as claimed in claim 1, wherein the first coupling element is an unbalanced antenna element.

12. An antenna arrangement as claimed in claim 1, wherein the first coupling element is positioned at or near a location where an E field generated by the conductive element, in use, is high.

13. An antenna arrangement as claimed in claim 1, wherein the conductive element has a first edge and a second opposing edge that are separated by a length of the conductive element, wherein the first coupling element is positioned at or near the first edge.

14. An antenna arrangement as claimed in claim 13, wherein the extension element and the conductive element partially overlap.

15. An antenna arrangement as claimed in claim 1, wherein the conductive element is a printed wiring board.

16. An antenna arrangement as claimed in claim 1, wherein the extension element is planar, the conductive element is planar, and the extension element is parallel to but separated from the plane of the planar conductive element.

17. An antenna arrangement as claimed in claim 1, wherein the conductive element has a first edge and a second opposing edge that are separated by a length of the conductive element, wherein the reactive element is positioned at or near the second edge.

18. An antenna arrangement as claimed in claim 1, wherein the reactive element is positioned at or near a position of significant E field.

19. An antenna arrangement as claimed in claim 1, wherein the reactive element is an inductor having an inductance value of a few nH to a few tens of nH.

20. A communications device comprising an antenna arrangement as claimed in claim 1.

21. An antenna arrangement comprising:

a coupling element, a conductive element, an extension element for electrically extending the conductive element and a reactive element, wherein a controllable element is used to connect/disconnect the reactive element.

22. An antenna arrangement as claimed in claim 21, wherein the extended conductive element operates as a ground plane for the coupling element, and wherein the extended conductive element has a greater electrical volume than the coupling element.

23. An antenna arrangement as claimed in claim 22, wherein the coupling element is positioned at or near a location where an E field generated by the conductive element, in use, is high.

24. An antenna arrangement comprising:

a coupling element, a conductive element, an extension element for electrically extending the conductive element and a reactive element, wherein a controllable element is used to control the reactance of the reactive element.

25. An antenna arrangement as claimed in claim 24, wherein the extended conductive element operates as a ground plane for the coupling element, and wherein the extended conductive element has a greater electrical volume than the coupling element.

26. An antenna arrangement as claimed in claim 24, wherein the coupling element is positioned at or near a location where an E field generated by the conductive element, in use, is high.

27. An antenna arrangement comprising:

a coupling element, a conductive element, an extension element for electrically extending the conductive element and a reactive element, wherein a controllable element is used to select one of a plurality of reactive elements.

28. An antenna arrangement as claimed in claim 27, wherein the extended conductive element operates as a ground plane for the coupling element, and wherein the extended conductive element has a greater electrical volume than the coupling element.

29. An antenna arrangement as claimed in claim 27, wherein the coupling element is positioned at or near a location where an E field generated by the conductive element, in use, is high.

30. A communications device comprising having an extended configuration and an non-extended configuration and comprising an antenna arrangement comprising:

a coupling element, a conductive element, an extension element for electrically extending the conductive element and a reactive element, wherein the reactive element has a reactance value which is controlled to change value when the configuration of the device changes between the non-extended and extended configuration.

31. A communications device as claimed in claim 30, wherein the extended conductive element operates as a ground plane for the coupling element, and wherein the extended conductive element has a greater electrical volume than the coupling element.

32. A communications device as claimed in claim 30, wherein the coupling element is positioned at or near a location where an E field generated by the conductive element, in use, is high.

* * * * *